US008597084B2

(12) United States Patent
Chen

(10) Patent No.: US 8,597,084 B2
(45) Date of Patent: Dec. 3, 2013

(54) TEXTURED PLATEN

(75) Inventor: Hung Chih Chen, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 573 days.

(21) Appl. No.: 12/577,351

(22) Filed: Oct. 12, 2009

(65) Prior Publication Data

US 2010/0099340 A1 Apr. 22, 2010

Related U.S. Application Data

(60) Provisional application No. 61/105,986, filed on Oct. 16, 2008.

(51) Int. Cl.
*B24B 7/22* (2006.01)

(52) U.S. Cl.
USPC ..... 451/288; 451/290

(58) Field of Classification Search
USPC ..... 451/56, 285–290
See application file for complete search history.

(56) References Cited

U.S. PATENT DOCUMENTS

| | | | | |
|---|---|---|---|---|
| 2,819,568 | A * | 1/1958 | Kasick | 451/488 |
| 3,726,056 | A * | 4/1973 | Harris et al. | 52/483.1 |
| 5,483,331 | A * | 1/1996 | Wayman et al. | 399/330 |
| 6,220,942 | B1 * | 4/2001 | Tolles et al. | 451/65 |
| 6,431,964 | B1 * | 8/2002 | Ishikawa et al. | 451/65 |
| 6,641,471 | B1 * | 11/2003 | Pinheiro et al. | 451/526 |
| 6,699,104 | B1 * | 3/2004 | Baker et al. | 451/28 |
| 6,706,140 | B2 * | 3/2004 | Hsu et al. | 156/345.13 |
| 6,722,949 | B2 * | 4/2004 | Hu et al. | 451/36 |
| 6,945,857 | B1 | 9/2005 | Doan et al. | |
| 7,534,162 | B2 * | 5/2009 | Bottema et al. | 451/41 |
| 2001/0005667 | A1 * | 6/2001 | Tolles et al. | 451/287 |
| 2001/0031612 | A1 | 10/2001 | Scott et al. | |
| 2002/0108861 | A1 * | 8/2002 | Emesh et al. | 205/81 |
| 2004/0053566 | A1 | 3/2004 | Tolles et al. | |
| 2004/0072518 | A1 * | 4/2004 | Prabhu et al. | 451/288 |
| 2005/0095963 | A1 * | 5/2005 | Stark et al. | 451/259 |
| 2006/0185795 | A1 | 8/2006 | Choi et al. | |
| 2007/0054601 | A1 * | 3/2007 | Bottema et al. | 451/41 |
| 2009/0258574 | A1 * | 10/2009 | Yilmaz et al. | 451/28 |

FOREIGN PATENT DOCUMENTS

| | | |
|---|---|---|
| JP | 09-057608 | 3/1997 |
| KR | 2008-0046715 | 5/2008 |

OTHER PUBLICATIONS

PCT International Search Report and Written Opinion dated Apr. 26, 2010 for International Application No. PCT/US2009/060356.

* cited by examiner

*Primary Examiner* — Maurina Rachuba
(74) *Attorney, Agent, or Firm* — Patterson & Sheridan, LLP

(57) ABSTRACT

Embodiments described herein generally relate to the planarization of substrates. In one embodiment, an apparatus for polishing a substrate is provided. The apparatus comprises a rotatable platen having a textured upper surface, at least one groove formed in the upper surface, and a pad disposed on the textured upper surface and bridging the at least one groove.

19 Claims, 5 Drawing Sheets

TEXTURED PLATEN

CROSS-REFERENCE TO RELATED APPLICATIONS

This application claims benefit of U.S. provisional patent application Ser. No. 61/105,986, filed Oct. 16, 2008, which is herein incorporated by reference.

BACKGROUND OF THE INVENTION

1. Field of the Invention

Embodiments of the present invention generally relate to an apparatus for polishing substrates.

2. Description of the Related Art

Sub-quarter micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

Multilevel interconnects are formed using sequential material deposition and material removal techniques on a substrate surface to form features therein. As layers of materials are sequentially deposited and removed, the uppermost surface of the substrate may become non-planar across its surface and require planarization prior to further processing. Planarization or "polishing" is a process in which material is removed from the surface of the substrate to form a generally even, planar surface. Planarization is useful in removing excess deposited material, removing undesired surface topography, and surface defects, such as surface roughness, agglomerated materials, crystal lattice damage, scratches, and contaminated layers or materials to provide an even surface for subsequent photolithography and other semiconductor manufacturing processes.

Chemical Mechanical Planarization, or Chemical Mechanical Polishing (CMP), is a common technique used to planarize substrates. CMP utilizes a chemical composition, such as slurries or other fluid medium, for selective removal of materials from substrates. In conventional CMP techniques, a substrate carrier or polishing head is mounted on a carrier assembly and positioned in contact with a polishing pad disposed on a platen in a CMP apparatus. The carrier assembly provides a controllable pressure to the substrate, thereby pressing the substrate against the polishing pad. The pad is moved relative to the substrate by an external driving force. The CMP apparatus affects polishing or rubbing movements between the surface of the substrate and the polishing pad while dispersing a polishing composition to affect chemical activities and/or mechanical activities and consequential removal of materials from the surface of the substrate.

The polishing pad performing this removal of material must have the appropriate mechanical properties for substrate planarization while minimizing the generation of defects in the substrate during polishing. Such defects include scratches in the substrate surface caused by raised or bubbled areas of the pad formed during installation of the pad onto a platen.

Therefore, there is a need for improved methods and apparatus for reducing substrate defects during a chemical mechanical polishing process.

SUMMARY OF THE INVENTION

Embodiments described herein generally relate to the planarization of substrates. In one embodiment, an apparatus for polishing a substrate is provided. The apparatus comprises a rotatable platen having a textured upper surface and at least one groove formed in the upper surface, and a pad disposed on the textured upper surface and bridging the at least one groove.

In another embodiment a chemical mechanical polishing apparatus is provided. The apparatus comprises one or more polishing stations each including a rotatable platen wherein at least one of the rotatable platens has a textured upper surface and at least one groove formed in the upper surface, one or more polishing heads rotatably mounted above the rotatable platens, and a polishing pad disposed on the textured upper surface and bridging the at least one groove.

In yet another embodiment, a method for constructing a platen is provided. The method comprises providing a platen and texturing an upper surface of the platen. The upper surface of the platen may be textured using a bead blast process, etch-back process, or combinations thereof.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiment without specific recitation.

DETAILED DESCRIPTION

Embodiments described herein generally relate to an apparatus for polishing substrates. As the diameter and polishing surface area of polishing pads continues to increase, more care is required during the installation of polishing pads to prevent trapped air bubbles from forming between the platen and the polishing pad. If present in an installed polishing pad, large air bubbles can cause the substrate to slip out of the carrier head and smaller sized air bubbles create polishing uniformity issues. Automated inspection sensors may be used to detect trapped air bubbles but do nothing to prevent the initial formation of air bubbles.

Embodiments described herein reduce air bubble formation by texturing the surface of a platen to provide a leak path for air bubbles. In one embodiment, the platen surface can have a groove pattern, with a groove pitch of about 0.5 inches (1.5 cm) limiting the maximum diameter of a trapped air bubbles to about 0.5 inches (1.3 cm). Any bubbles larger than 0.5 inches (1.3 cm) will encounter a groove for air bleed. Various groove pitches and patterns can be selected to limit the size of air bubbles. In one embodiment, the groove cross section may comprise a shallow V groove, to facilitate cleaning of the grooves between pad changes.

In another embodiment, the textured surface of the platen may comprise a plurality of randomly distributed small dimples. In one embodiment, the randomly distributed dimples may be formed using a bead blast process, an etch-back process, or combinations thereof. In one embodiment, the platen may comprise uniformly distributed through holes. In another embodiment, the surface texture of the platen may be achieved by constructing the platen using a porous based material, such as a sintered ceramic matrix.

While the particular apparatus in which the embodiments described herein can be practiced is not limited, it is particularly beneficial to practice the embodiments in a REFLEXION® LK CMP system and MIRRA MESA® system sold by Applied Materials, Inc., Santa Clara, Calif. Additionally, CMP systems available from other manufacturers may also benefit from embodiments described herein. Embodiments described herein may also be practiced on overhead circular track polishing systems.

Figure 1:
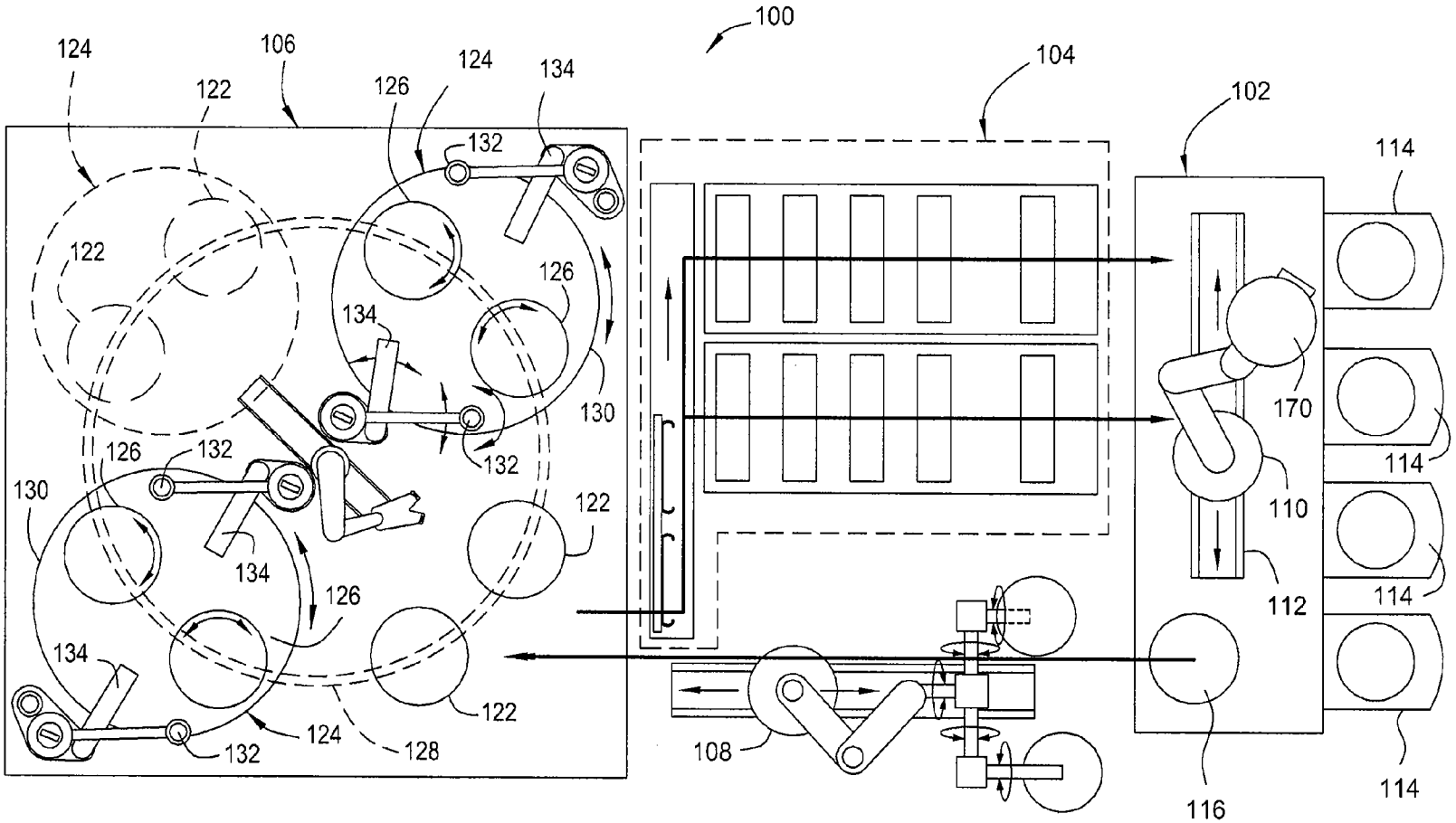
FIG. 1 is a is a top plan view of one embodiment of a chemical mechanical polishing system.

FIG. 1 is a top plan view illustrating one embodiment of a chemical mechanical polishing ("CMP") system 100. The CMP system 100 includes a factory interface 102, a cleaner 104 and a polishing module 106. A wet robot 108 is provided to transfer substrates 170 between the factory interface 102 and the polishing module 106. The wet robot 108 may also be configured to transfer substrates between the polishing module 106 and the cleaner 104. The factory interface 102 includes a dry robot 110 which is configured to transfer substrates 170 between one or more cassettes 114 and one or more transfer platforms 116. In one embodiment depicted in FIG. 1, four substrate storage cassettes 114 are shown. The dry robot 110 has sufficient range of motion to facilitate transfer between the four cassettes 114 and the one or more transfer platforms 116. Optionally, the dry robot 110 may be mounted on a rail or track 112 to position the robot 110 laterally within the factory interface 102, thereby increasing the range of motion of the dry robot 110 without requiring large or complex robot linkages. The dry robot 110 additionally is configured to receive substrates from the cleaner 104 and return the clean polish substrates to the substrate storage cassettes 114. Although one substrate transfer platform 116 is shown in the embodiment depicted in FIG. 1, two or more substrate transfer platforms may be provided so that at least two substrates may be queued for transfer to the polishing module 106 by the wet robot 108 at the same time.

Still referring to FIG. 1, the polishing module 106 includes a plurality of polishing stations 124 on which substrates are polished while retained in one or more polishing heads 126. The polishing stations 124 are sized to interface with two or more polishing heads 126 simultaneously so that polishing of two or more substrates may occur using a single polishing station 124 at the same time. The polishing heads 126 are coupled to a carriage 220 (shown in FIG. 2) that is mounted to an overhead track 128 that is shown in phantom in FIG. 1. The overhead track 128 allows the carriage 220 to be selectively positioned around the polishing module 106 which facilitates positioning of the polishing heads 126 selectively over the polishing stations 124 and load cup 122. In the embodiment depicted in FIG. 1, the overhead track 128 has a circular configuration which allows the carriages 220 retaining the polishing heads 126 to be selectively and independently rotated over and/or clear of the load cups 122 and the polishing stations 124. The overhead track 128 may have other configurations including elliptical, oval, linear or other suitable orientation and the movement of the polishing heads 126 may be facilitated using other suitable devices.

In one embodiment depicted in FIG. 1, two polishing stations 124 are shown located in opposite corners of the polishing module 106. At least one load cup 122 is in the corner of the polishing module 106 between the polishing stations 124 closest the wet robot 108. The load cup 122 facilitates transfer between the wet robot 108 and the polishing head 126. Optionally, a third polishing station 124 (shown in phantom) may be positioned in the corner of the polishing module 126 opposite the load cups 122. Alternatively, a second pair of load cups 122 (also shown in phantom) may be located in the corner of the polishing module 106 opposite the load cups 122 that are positioned proximate the wet robot. Additional polishing stations 124 may be integrated in the polishing module 106 in systems having a larger footprint.

Each polishing station 124 includes a polishing surface 130 capable of polishing at least two substrates at the same time and a matching number of polishing units for each of the substrates. Each of the polishing units includes a polishing head 126, a conditioning module 132 and a polishing fluid delivery module 134. In one embodiment, the conditioning module 132 may be a conditioner which dresses the pad by removing polishing debris and opening the pores of the pad. In another embodiment, the polishing fluid delivery module 134 may be a slurry delivery arm. The polishing surface 130 is supported on a platen assembly 200 (see FIG. 2) which rotates the polishing surface 130 during processing. In one embodiment, the polishing surface 130 is suitable for at least one of a chemical mechanical polishing and/or an electrochemical mechanical polishing process. In another embodiment, the platen may be rotated during polishing at a rate from about 10 rpm to about 150 rpm, for example, about 50 rpm to about 110 rpm, such as about 80 rpm to about 100 rpm.

Figure 2:
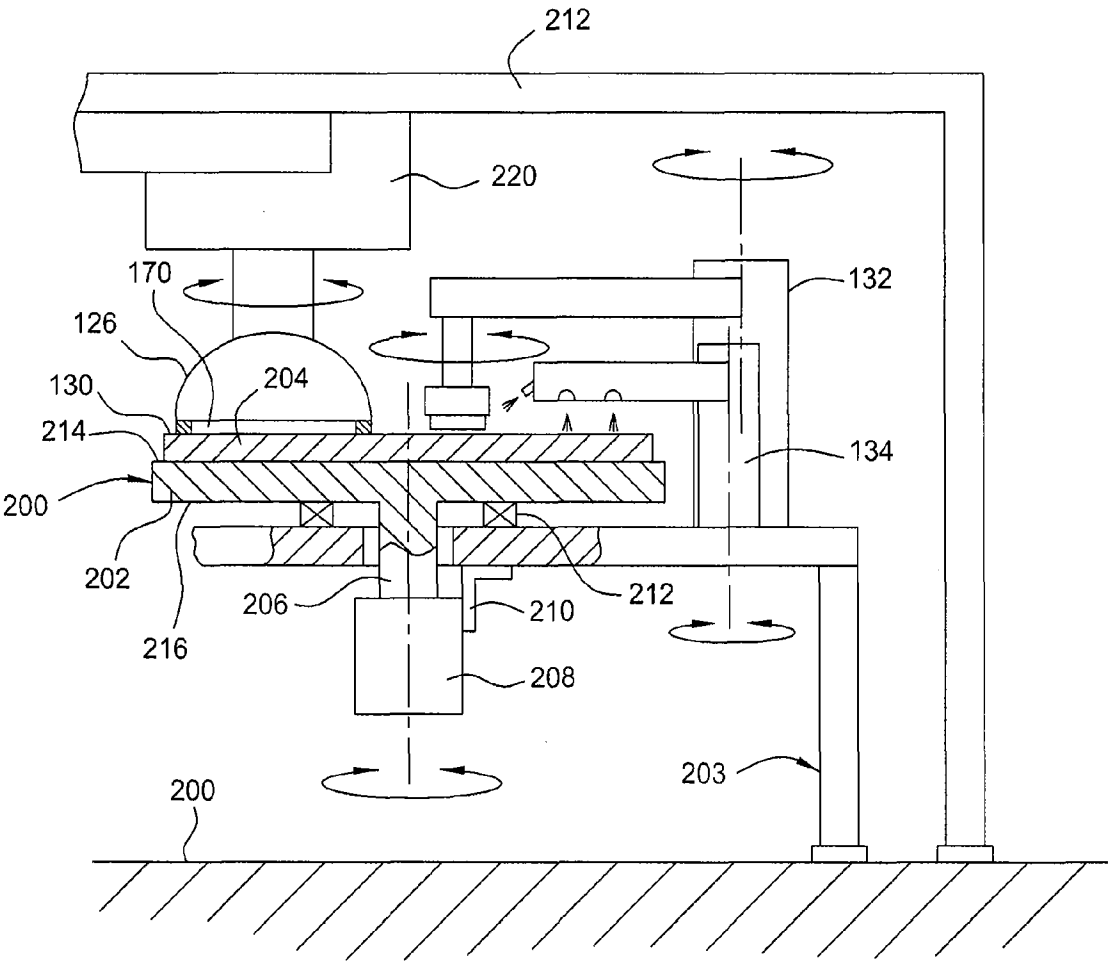
FIG. 2 is a partial side view of a polishing station of FIG. 1 according to one embodiment described herein.

FIG. 2 is a partial side view showing one embodiment of one of the polishing stations 124 of FIG. 1. Only one of the two or more polishing units is shown in FIG. 2 for ease of explanation. In the embodiment depicted in FIG. 2, a platen assembly 200 supports a polishing pad 204. The upper surface of the pad 204 forms the polishing surface 130. The platen 202 comprises an upper surface 214 and a lower surface 216. In one embodiment, the platen 202 and polishing pad 204 are sized to interface with two or more polishing heads 126 simultaneously so that polishing of two or more substrates may occur using a single polishing pad 204 at the same time. The platen 202 is movably supported on an inner frame 203 by one or more bearings 212. The platen 202 is coupled by a shaft 206 to a motor 208 that is operable to rotate the platen assembly 200. The motor 208 may be coupled by a bracket 210 to the inner frame 203. In one embodiment, the motor 208 is a direct drive motor. Other motors may also be utilized to rotate the shaft 206. In one embodiment depicted in FIG. 2, the motor 208 is utilized to rotate the platen assembly 200 such that the pad 204 retained thereon is rotated during processing while the substrate 170 is retained against the polishing surface 130 by the polishing head 126.

In one embodiment, the platen 202 may comprise a process resistant material selected from the group comprising ceramics, aluminum, steel, nickel, polymers, and combinations thereof. In one embodiment, the platen 202 may comprise at least one of aluminum oxide, aluminum nitride, silicon oxide, silicon carbide, silicon nitride, titanium oxide, zirconium oxide, and combinations thereof. The platen 202 may be unitary monolith of ceramic made by hot pressing and sintering a ceramic powder, and then machining the sintered form to form the final shape of the platen 202. In one embodiment, the platen 202 may be etched to form the final shape of the platen 202. In one embodiment, the platen 202 has a diameter greater than about 30 inches (76.2 cm), for example, between about 30 inches (76.2 cm) and about 52 inches (132.1 cm), such as 42 inches (106.7 cm).

In one embodiment, the polishing head 126 is rotated at a rate from a range of about 10 rpm to about 150 rpm, for example, about 50 rpm to about 110 rpm, such as about 80 rpm to about 100 rpm. The polishing head 126 may press the substrate 170 against the pad 204 at a pressure in range of about 0.5 psi to about 5.0 psi, for example, about 1 psi to about 4.5 psi, such as about 1.5 psi to about 4.0 psi, for example. The polishing head 126 may have a moving range preferably from about 10 (25.4 cm) to 14 inches (35.6 cm). The polishing head 126 may be sweeping from a frequency of about 1 sweep per minute (swp/min) to about 40 swp/min, for example, about 5 swp/min to about 30 swp/min, such as about 12 swp/min to about 25 swp/min. Each sweep may be about 10 (25.4 cm) to about 14 inches (35.6 cm).

The platen assembly 200 is sized to support a polishing pad 204 which will accommodate polishing of at least two substrates retained by different polishing heads 126 and served by different polishing units. In one embodiment, the dielectric polishing pad 204 has a diameter greater than about 30 inches (76.2 cm), for example, between about 30 (76.2 cm) and about 52 inches (132.1 cm), such as 42 inches (106.7 cm). Even though the dielectric polishing pad 204 may be utilized to polish two substrates simultaneously, the pad unit area per number of substrate simultaneously polished thereon is much greater than conventional single substrate pads, thereby allowing the pad service life to be significantly extended.

Figure 3A:
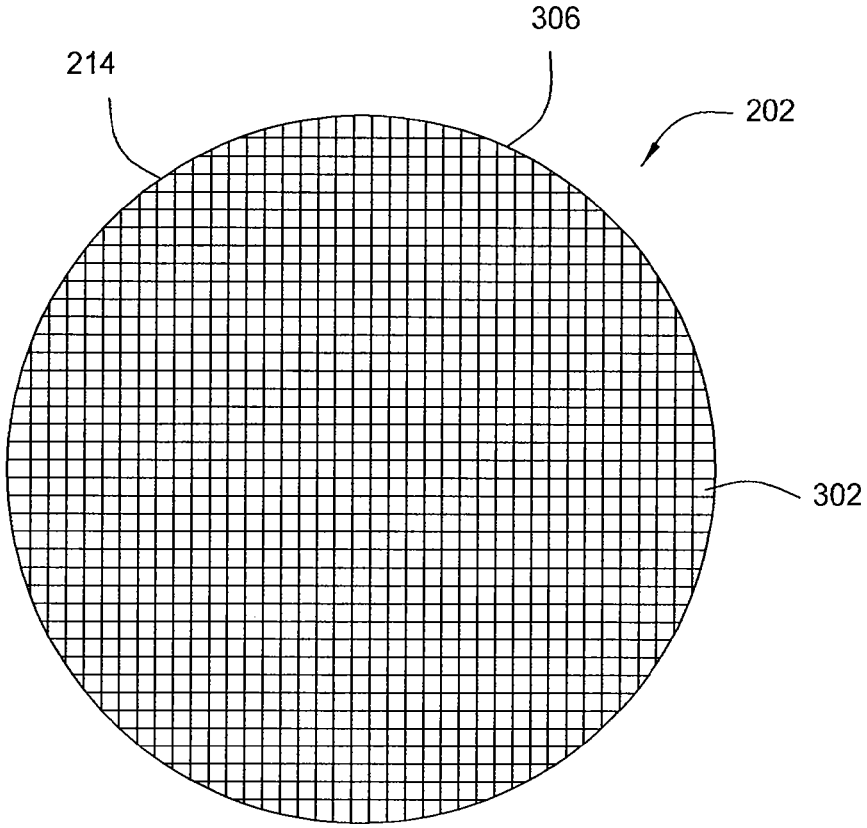
FIG. 3A is a top view of a platen according to one embodiment described herein.
Figure 3B:
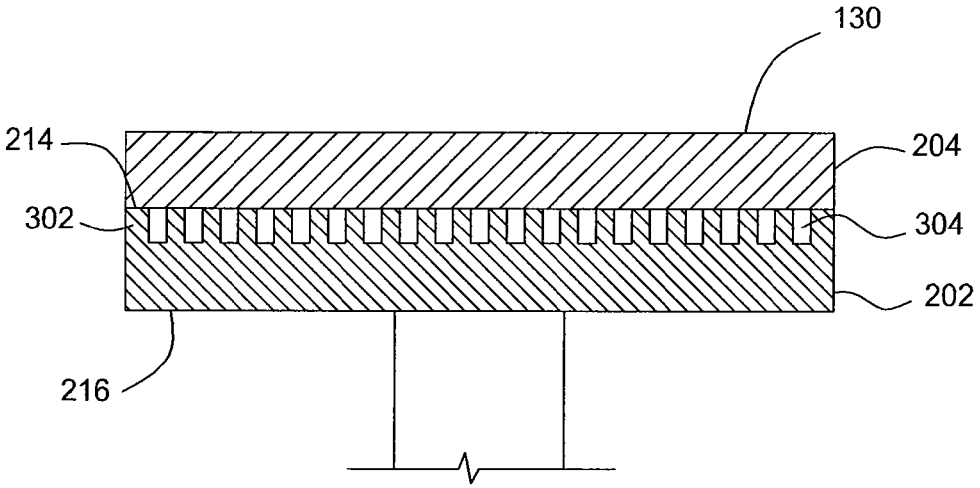
FIG. 3B is a schematic side view of one embodiment of the platen in FIG. 3A having a pad disposed thereon.

FIG. 3A is a top view of a platen 202 according to one embodiment described herein and FIG. 3B is a schematic side view of the platen 202 in FIG. 3A having a pad 204 disposed thereon. The platen 202 comprises a patterned surface on which a polishing pad 204 may be disposed. The patterned surface may have features formed thereon defining raised features and a recessed area. In one embodiment, the patterned surface of the platen 202 may be textured using embodiments described herein. In one embodiment, the raised area consists of a plurality of protrusions 302 and the recessed area consists of a plurality of intersecting grooves 304. In one embodiment, at least one of the grooves 304 extends across the surface of the platen 202 from one edge 306 to the other edge 306. In another embodiment, the intersecting grooves 304 may be contained by blocking the groove 304 at both ends. In another embodiment, the groove 304 may be blocked at one end.

In one embodiment, the groove 304 has a groove pitch between about 0.005 inches (0.127 mm) and about 1 inch (25.4 mm), for example, between about 0.005 inches (0.127 mm) to about 0.050 inches (1.27 mm), such as about 0.020 inches (0.508 mm). A groove pitch of 0.5 inches limits the maximum diameter of a trapped air bubble to about 0.5 inches (12.7 mm). Any bubbles larger than 0.5 inches in diameter will encounter a groove 304 for air bleed. Various groove pitches and patterns can be selected to limit the size of air bubbles. In one embodiment, the groove cross section may comprise a shallow V groove, to facilitate cleaning of the grooves between pad changes. In one embodiment, the groove 304 has a depth of between about 0.003 inches (0.0762 mm) to about 0.025 inches (0.635 mm), for example, about 0.010 inches (0.254 mm).

In one embodiment, the intersecting grooves 304 may form an X-Y groove pattern. Although an X-Y groove pattern is shown the embodiments described herein contemplate other groove patterns including spiral, hexagonal, circular, and any other groove pattern that allows for the escape of trapped air bubbles when installing a polishing pad on the platen 202.

The protrusions 302 and the grooves 304 shown in FIGS. 3A and 3B may be defined by machining away a portion of the upper surface of the platen 202. However, the embodiments described herein also contemplate other methods for forming the protrusions 302 and the grooves 304. For example, the plurality of protrusions 302 may be constructed separately from the platen 202. The protrusions 302 may then be secured to the surface of the platen 202 by conventional methods such as brazing or welding. In another embodiment, the platen 202 may comprise two separable plates with a lower plate secured to the motor 208 (shown in FIG. 2) and an upper plate comprising the patterned surface for mounting the pad 204. The plates may be permanently coupled by such methods as welding, or they may be detachably coupled by temporary fasteners or clamps. The latter embodiment provides a versatile platen assembly having an exchangeable mounting surface.

Figure 4A:
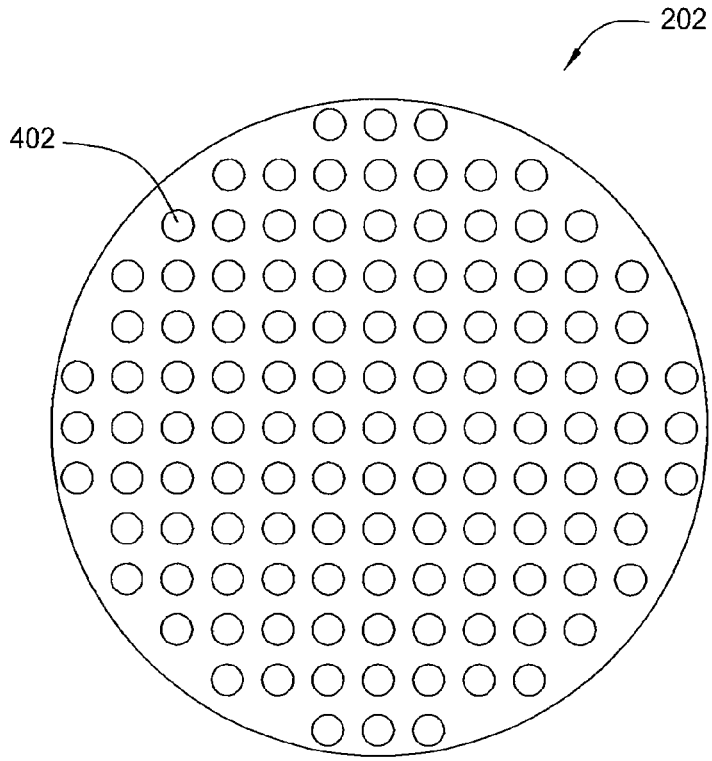
FIG. 4A is a top view of a platen according to another embodiment described herein.
Figure 4B:
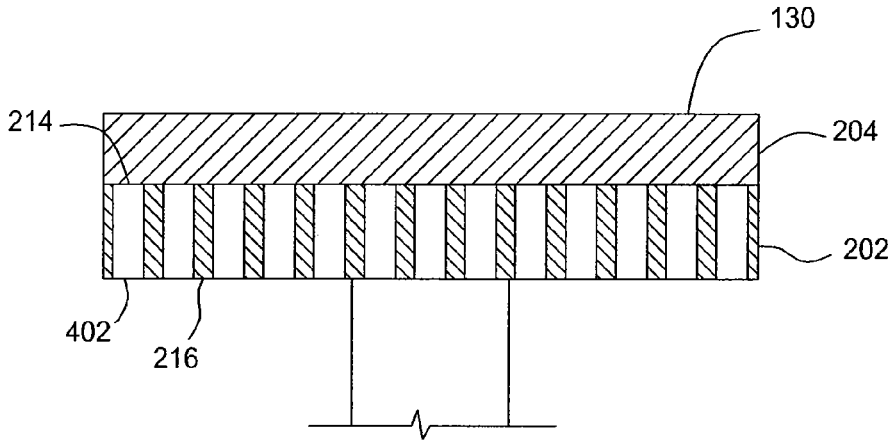
FIG. 4B is a schematic side view of one embodiment of the platen of FIG. 4A having a pad disposed thereon.

FIG. 4A is a top view of a platen 202 according to another embodiment described herein and FIG. 4B is a schematic side view of the platen 202 of FIG. 4A having a pad 204 disposed thereon. In one embodiment, the platen 202 may comprise a plurality of through holes 402 formed between the lower surface 216 and the upper surface 214 of the platen 202. In one embodiment, the through holes 402 may be uniformly distributed. In another embodiment, the through holes 402 may be randomly distributed. In one embodiment, the upper surface 214 of the platen may be textured using embodiments described herein.

Although the through holes 402 as shown in FIGS. 4A and 4B form a uniform X-Y pattern the embodiments described herein contemplate other patterns including spiral, hexagonal, circular, and any other pattern that allows for the escape of trapped air bubbles when installing a polishing pad on the platen 202. In one embodiment, the through holes 402 may be between 0.010 inches (0.254 mm) and about 0.500 inches (12.7 mm) in diameter. In one embodiment, the spacing between the edge of adjacent through holes 402 is between about 0.005 inches (0.127 mm) and about 1 inch (25.4 mm), for example, between about 0.005 inches (0.127 mm) to about 0.050 inches (1.27 mm), such as about 0.020 inches (0.508 mm). Various diameters and patterns of the through holes 402 can be selected to limit the size of air bubbles present.

Figure 5:
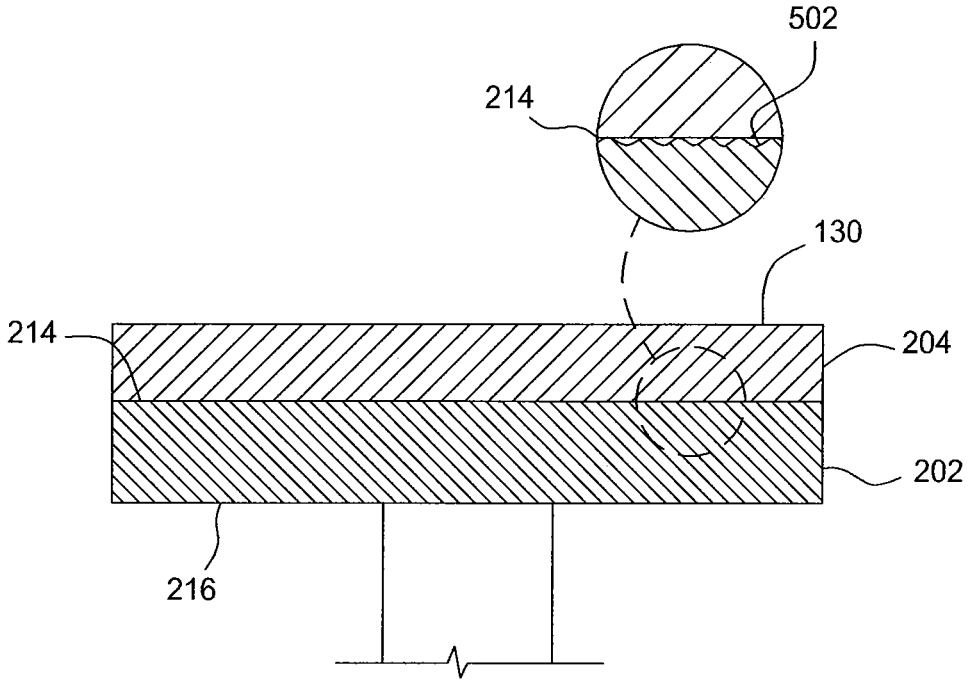
FIG. 5 is a schematic side view of a platen having a pad disposed thereon according to another embodiment described herein.

FIG. 5 is a schematic side view of a platen 202 having a pad 204 disposed thereon according to another embodiment described herein. In one embodiment, the upper surface 214 of the platen 202 may be textured. In one embodiment the textured surface comprises randomly distributed dimples 502. In one embodiment, the upper surface 214 of the platen 202 may be roughened to form randomly distributed dimples 502 on the upper surface 214 of the platen 202. The upper surface 214 may be roughened using a bead blast process, an etch-back process, or combinations thereof.

In one embodiment, the dimples 502 may be formed using a bead blast process. This method increases the surface roughness of the upper surface 214 of the platen 202. This method increases the root mean square ("RMS") roughness of the upper surface 214 of the platen 202 from about 0.75 microns to about 6 microns, for example, between about 1.5 microns and about 5 microns, for example about 2 microns. In bead blasting, solid beads are propelled toward the surface by air at a pressure that is suitably high to roughen the surface. The beads may comprise a material having a hardness higher than that of the underlying structure to allow the beads to erode and roughen the upper surface 214 of the platen 202. Suitable bead materials include for example, aluminum oxide, glass, silica, hard plastic, garnet, silicon carbide, silicon oxide, and combinations thereof. In one embodiment, the bead materials may have a particle size of between about 24 to about 80 grit (about 535 microns to about 192 microns).

In one embodiment, the dimples 502 may be formed by chemically roughening the upper surface 214 of the platen 202. The term chemically roughened should be broadly construed and includes, but is not limited to, chemically etching the surface of the platen 202, electrochemically etching the surface of the platen 202, or combinations thereof. The chemical roughening process, like the bead blasting process described above, is used to form a rough surface that reduces the formation of air bubbles on the surface of an installed polishing pad. The method of chemically roughening the surface of the platen 202 depends on the material from which the platen is made and should be commonly known or understood by one skilled in the art of chemical cleaning, metallography, and chemical machining. The term chemically etching is meant to generally describe, but is not limited to, the process of removing material from the surface of a platen 202 by the use of chemical activity. An example of typical chemicals that could be used may be aqueous acidic solutions, containing such acids as sulfuric acid ($H_2SO_4$), nitric acid ($HNO_3$), hydrochloric acid (HCl), or combination thereof, or aqueous basic solutions containing such chemicals as potassium hydroxide (KOH), ammonia hydroxide ($NH_4OH$) or combination thereof. In another embodiment the process of chemical etching the surface of the platen 202 may also be completed by use of dry etching (plasma etch) process. Dry etching is generally a process of generating plasma to energize or dissociate reactive gas species that interact with and ultimately remove material from the surface of the platen 202. The term electrochemically etching is meant to generally describe, but is not limited to, the process of removing material from the surface of the platen 202 by the application of an anodic bias to the platen 202 relative to another element that acts as a cathode and is also submerged in an electrolyte solution.

It should be understood that the platen 202 may comprise any combination of grooves, textured surfaces, and through holes.

While the foregoing is directed to embodiments of the present invention, other and further embodiments of the invention may be devised without departing from the basic scope thereof, and the scope thereof is determined by the claims that follow.

The invention claimed is:

1. An apparatus for polishing a substrate, comprising:

a rotatable platen having:

a textured upper surface; and a plurality of grooves formed in the textured upper surface; and a pad disposed on the rotatable platen, wherein the pad has a planar backside contacting the upper surface of the rotatable platen and bridging the plurality of grooves, the plurality of grooves has a groove pitch between about 0.005 inches and about 0.05 inches, and the plurality of grooves and the planar backside of the pad define a plurality of pathways extending to a perimeter of the rotatable platen to allow fluid communication between the planar backside of the pad and an environment of the rotatable platen.

2. The apparatus of claim 1, wherein the textured upper surface has a root mean square roughness from about 0.75 microns to about 6 microns.

3. The apparatus of claim 2, wherein the textured upper surface has a root mean square roughness from about 1.5 microns to about 5 microns.

4. The apparatus of claim 1, wherein the pad comprises polyurethane.

5. The apparatus of claim 1, wherein the rotatable platen is part of a chemical mechanical polishing system.

6. The apparatus of claim 1, wherein the rotatable platen comprises a material selected from the group comprising: aluminum, steel, nickel, polymers, aluminum oxide, aluminum nitride, silicon oxide, silicon carbide, silicon nitride, titanium oxide, zirconium oxide, and combinations thereof.

7. The apparatus of claim 1, wherein the plurality of grooves are disposed in a grid pattern.

8. The apparatus of claim 1, wherein the rotatable platen has at least one through hole.

9. The apparatus of claim 1, wherein the platen has a diameter between about 30 inches and about 52 inches.

10. A chemical mechanical polishing apparatus, comprising:

one or more polishing stations each including a rotatable platen wherein at least one of the rotatable platens has a textured upper surface and a plurality of grooves formed in the upper surface;

one or more polishing heads rotatably mounted above the rotatable platens; and a polishing pad disposed on the rotatable platen, wherein the polishing pad has a planar backside contacting the textured upper surface of the rotatable platen and bridging the plurality of grooves, the plurality of grooves has a groove pitch between about 0.005 inches and about 0.05 inches, and the plurality of grooves and the planar backside of the polishing pad define a plurality of pathways extending to a perimeter of the rotatable platen to allow fluid communication between the planar backside of the pad and an environment of the rotatable platen.

11. The apparatus of claim 10, wherein the textured upper surface has a root mean square roughness from about 0.75 microns to about 6 microns.

12. The apparatus of claim 11, wherein the textured upper surface has a root mean square roughness from about 1.5 microns to about 5 microns.

13. The apparatus of claim 10, wherein the one or more polishing heads are rotatably mounted to an overhead track comprising a circular rail.

14. The apparatus of claim 10, wherein the rotatable platen comprises a material selected from the group comprising: aluminum, steel, nickel, polymers, aluminum oxide, aluminum nitride, silicon oxide, silicon carbide, silicon nitride, titanium oxide, zirconium oxide, and combinations thereof and wherein the at least one groove is disposed in a grid pattern.

15. The apparatus of claim 12, wherein the platen has at least one through hole.

16. The apparatus of claim 12, wherein the platen is sized to support a polishing pad which can accommodate simultaneous polishing of at least two substrates retained by different polishing heads.

17. The apparatus of claim 1, wherein the plurality of grooves extend across the surface of the platen from one edge of the platen to another edge of the platen.

18. The apparatus of claim 1, wherein a cross section of each of the plurality of grooves is a shallow V to facilitate cleaning of the plurality of grooves between pad changes.

19. The apparatus of claim 10, wherein a cross section of each of the plurality of grooves is a shallow V to facilitate cleaning of the plurality of grooves between pad changes.

* * * * *